US005423699A

United States Patent [19]

Johnson

[11] Patent Number: 5,423,699

[45] Date of Patent: Jun. 13, 1995

[54] ELECTRICAL CONNECTOR

[75] Inventor: Barry J. Johnson, West Hill, Canada

[73] Assignee: The Whitaker Corporation, Wilmington, Del.

[21] Appl. No.: 118,106

[22] Filed: Sep. 8, 1993

[51] Int. Cl.[6] ..... H01R 4/50

[52] U.S. Cl. ..... 439/783; 439/807

[58] Field of Search ..... 439/783, 790, 791, 794, 439/796, 803, 807

[56] References Cited

U.S. PATENT DOCUMENTS

| | | | |
|---|---|---|---|
| 3,065,449 | 11/1962 | Matthysse et al. . | |
| 3,349,167 | 10/1967 | Mixon, Jr. et al. | 174/94 |
| 3,522,365 | 7/1970 | Dannes | 174/94 |
| 3,544,956 | 12/1970 | Bricker, Jr. . | |
| 4,027,939 | 6/1977 | White . | |
| 4,114,977 | 9/1978 | Polidori . | |
| 4,279,461 | 7/1981 | Bussen et al. . | |
| 4,415,222 | 11/1983 | Polidori . | |
| 4,533,205 | 8/1985 | Frank . | |
| 4,600,264 | 7/1986 | Counsel . | |
| 4,650,273 | 3/1987 | Roosdorp . | |
| 4,730,087 | 3/1988 | Werner | 439/783 |
| 4,857,020 | 8/1989 | Crosby | 439/783 |
| 5,092,797 | 3/1992 | Cole et al. | 439/783 |
| 5,092,797 | 3/1992 | Cole et al. | 439/783 |
| 5,145,420 | 9/1992 | Counsel et al. | 439/783 |

*Primary Examiner*—Larry I. Schwartz
*Assistant Examiner*—Hien D. Vu
*Attorney, Agent, or Firm*—Katherine A. Nelson

[57] ABSTRACT

An electrical connector 50 of the type having a C-shaped body member 52 having laterally opposing arcuate ears 60 extending therealong from a wide to a narrow end, the wide end being adapted to receive a wedge member 72 having opposed converging side surfaces 80 defining wire-receiving channels 70 in cooperation with corresponding ones of the arcuate ears 60 opposed therefrom, all for receipt thereinto of respective uninsulated wire conductors therealong to be interconnected upon compression between the wedge member 72 and the C-shaped body member 52 by actuation of a drive bolt 44 causing the wedge member 72 to be driven into the wide end of the C-shaped body member and held therein. The C-shaped body member 52 includes an axial corrugation 64 extending from a far end to a transverse section at a bolt receiving end 67 defining a bolt receiving relief 65, the relief 65 having a concave dimension just large enough to permit passage of a bolt shank therealong. A bolt receiving aperture 68 is positioned in a transverse body section 58 so that the centerline thereof extends therefrom along the bolt receiving relief 65, whereby the bolt shank 46 is just recessed below the plane defined by the wedge proximate surface, thereby minimizing the distance between the centerline of bolt 44 and the centerline of wedge 72 thus minimizing skewing of wedge 72 as the connector 50 is assembled.

2 Claims, 3 Drawing Sheets

ELECTRICAL CONNECTOR

FIELD OF THE INVENTION

This invention relates to the field of electrical connectors, and, more particularly, to connectors for electrically and mechanically connecting a pair of uninsulated wire conductors.

BACKGROUND OF THE INVENTION

Electrical connectors that interconnect a pair of uninsulated wire conductors are known. The connectors include a conductive insert that is wedged into a C-shaped member, compressing the wires between ear-like sections of the C-shaped member and opposing concave surfaces of the sides of the wedge. Typically, the connector uses an installation or drive bolt to force the wedge-shaped member into the C-shaped member until the wires are sufficiently compressed there between. The examples of connectors of this type are found in U.S. Pat. Nos. 4,600,264 and 5,092,797. One such product is sold by AMP of Canada Ltd., Markham, Ontario, Canada under the trademark "AMP WRENCH-LOK Connector".

In the devices disclosed above, the separate wedge is engaged with a captive insertion bolt or drive screw that engages a threaded aperture in a flange extending outwardly from the outer surface of C-shaped member. The captive nature is provided by a lateral slotted lug. The screw and lug are latterly shiftable with respect to one another to allow the wedge to be free-floating to accommodate different sizes of conductors. As the bolt or screw is tightened, force is applied to the back of the wedge to cause the wedge to enter the body.

SUMMARY OF THE INVENTION

The present invention is an electrical connector of the type having a C-shaped body member having opposing arcuate ears extending laterally therealong and converging from a wide end to a narrow end, a wedge member having opposed converging side surfaces concave therealong defining wire-receiving channels in cooperation with corresponding ones of the arcuate ears opposed therefrom and a drive bolt for causing the wedge member to be driven into the wide end of the C-shaped body and held therein. One of the ends of the C-shaped body member is a bolt receiving end having a bolt receiving aperture extending therethrough, the body member including a transverse section at least at the bolt receiving end. The C-shaped body member further includes an axial corrugation extending from a far end to the transverse section at the bolt receiving end defining a bolt receiving relief, the relief having a concave dimension just large enough to permit passage of a bolt shank therealong. The bolt receiving aperture is positioned in the transverse section so that the centerline thereof extends therefrom along the bolt receiving relief. In the assembled connector the bolt shank is just recessed below the plane defined by the wedge proximate surface. This position minimizing the distance between the centerline of the bolt and the centerline of the wedge thus minimizing skewing of the wedge as the connector is assembled and thereby facilitating assembly.

It is an object of the present invention to provide a C-shaped connector with a wedge member that minimizes skewing of the wedge member as the connector is assembled.

It is another object of the invention to provide a C-shaped connector with a wedge member that minimizes contact between the bodies of the C-shaped member and the wedge member as the connector is assembled.

It is an additional object of the invention to provide a C-shaped connector assembly that maximizes the spring action of the C-shaped body member to assure high clamping force between the connector and a pair of conductors.

It is a further object of the invention to provide a C-shaped connector assembly in which the torque applied to secure the connector to a pair of conductors is directed to the assembly of the connector rather than to overcoming interference between the bodies of the C-shaped member and a wedge member.

Another object of the invention is to provide a C-shaped connector assembly which facilitates removal of the bolt, if necessary.

A representative embodiment of the present invention will now be described by way of example with reference to the accompanying drawings.

DETAILED DESCRIPTION OF THE DRAWINGS

Figure 1:
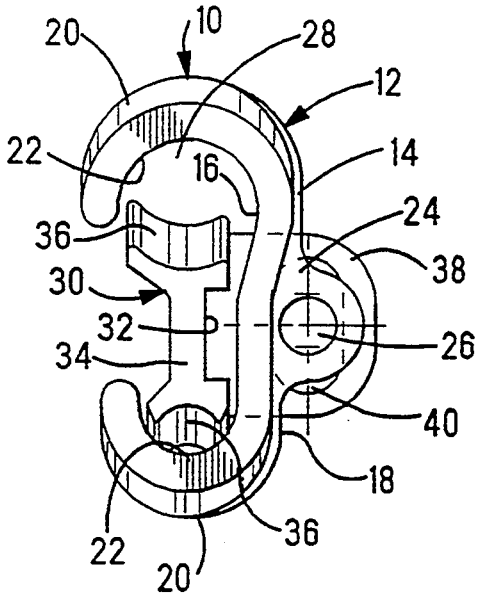
Fig. 1 PRIOR ART
FIG. 1 is end view of an assembled prior art connector.
Figure 2:
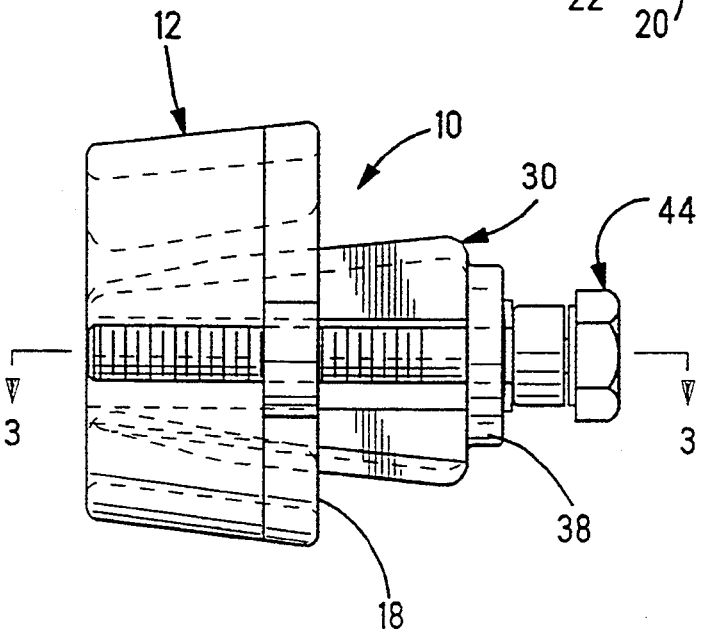
Fig. 2 PRIOR ART
FIG. 2 is a top plan view of the prior art connector of FIG. 1.
Figure 3:
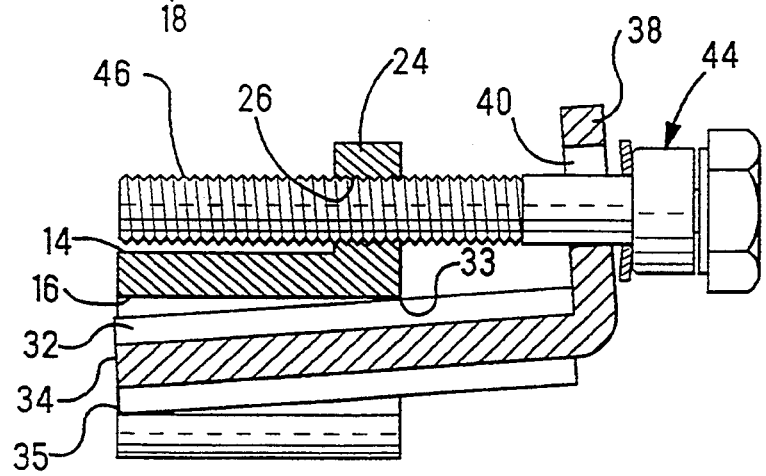
Fig. 3 PRIOR ART
FIG. 3 is a cross-sectional view of the prior art connector of FIG. 1 taken along line 3—3 of FIG. 2.

The prior art connector 10, as shown in FIGS. 1, 2 and 3, includes a C-shaped body member 12, a wedge member 30, and an installation or drive bolt 44. C-shaped body member 12 has an outer surface 14 and inner surface 16 and includes a transverse section 18, extending laterally to opposed arcuate ears 20 defining wire grooves 22 that converge from one end toward the other end along the transverse section 18. An axial flange embossment 24 is disposed centrally of the transverse section 18, the outer surface 14 of the C-shaped body member 12. Embossment 24 includes a threaded aperture 26 into which bolt 44 will be threaded during application. Wedge member 30 includes a solid body shaped and dimensioned to be received into C-shaped body member 12 from the relatively opened end thereof and a transverse flange 38. Wedge member 30 includes top surface 32, leading end 34 and converging concave side surfaces 36 therealong that cooperate with opposing wire grooves 22 of C-shaped body member 12 to define wire channels 28 for containing conductors therein. Transverse flange 38 extends outwardly from the wedge body member 30 at a wide end and includes a slot 40 therethrough, through which the shank of the drive bolt 60 will be inserted prior to being threaded into aperture 26 of C-shaped body member 12. As can best be seen in FIG. 3, the line of action of bolt 26, being spaced some distance above the line of contact between the wedge 30 and conductors produces a moment, which often causes the narrow leading end 34 of the wedge 30 to tip downward and stub against the inner surface 16 of body member 12 and the back portion of the wedge 30 to tip upwardly and engage the inner surface 16 of the body member 12 near the wedge flange 38 and slot 40, thereby making installation difficult. The resulting tipping limits the spring action of the C-shaped body member 12 and increases the amount of torque needed to complete assembly. The bolt 44 is also deflected upward during installation thus making the bolt 44 more difficult to remove when necessary.

Figures 4, 5:
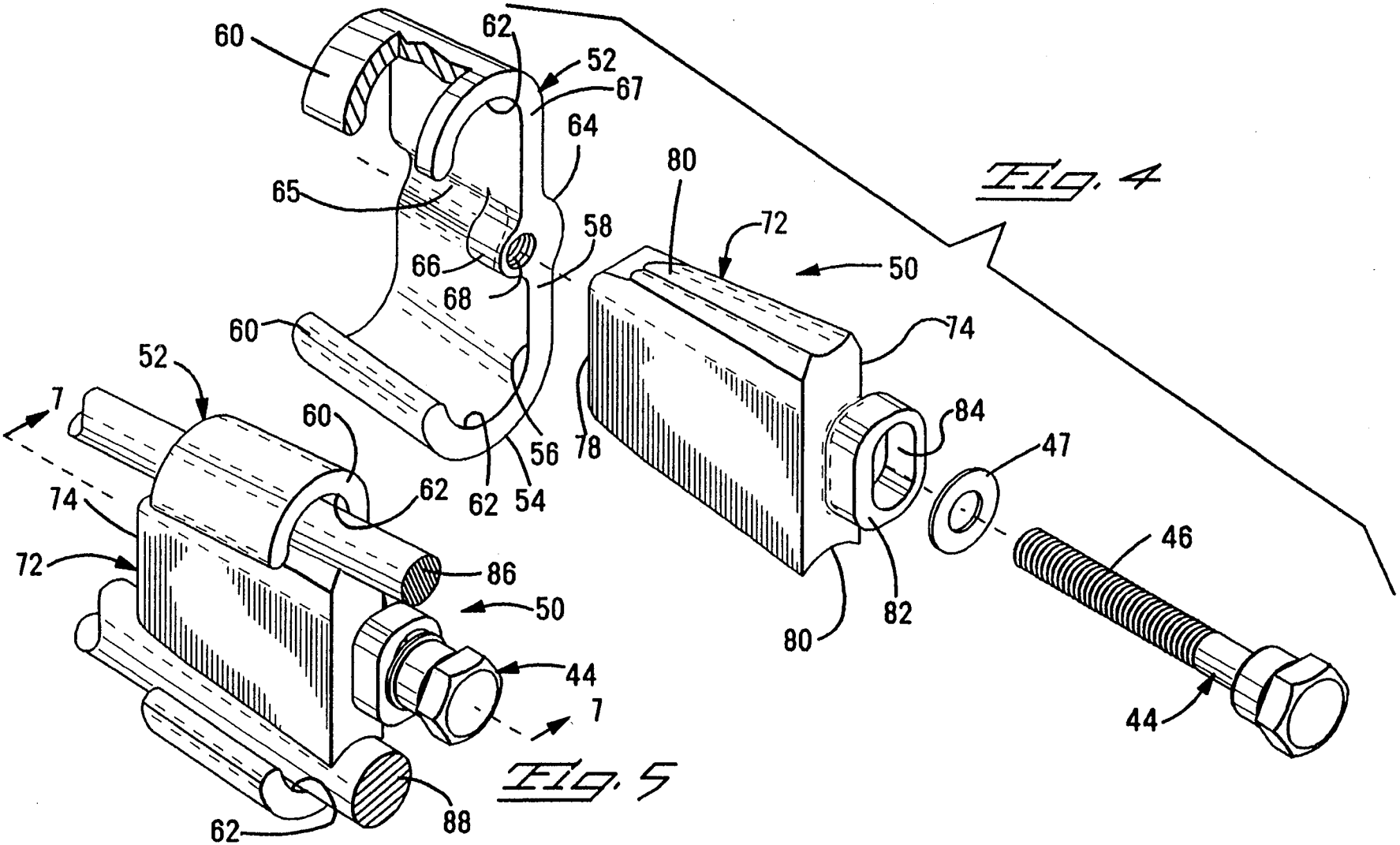
FIG. 4 is an exploded perspective view of the connector of the present invention with a portion of the side wall cut away.
FIG. 5 is an assembled view of the connector of FIG. 4 interconnecting two conductors.
Figure 6:
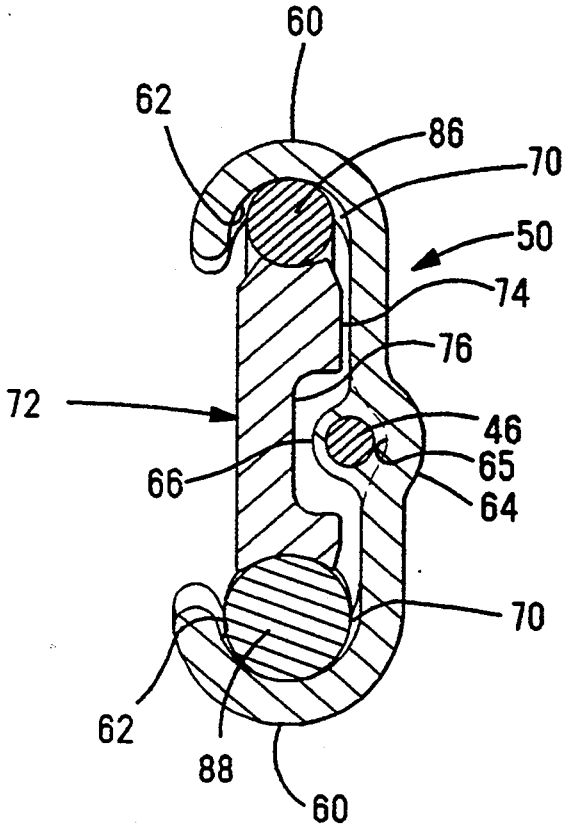
FIG. 6 is an end view of the assembled connector of FIG. 5.

Referring now to FIGS. 4 through 7, the connector 50 of the present invention includes a C-shaped body member 52, a wedge member 72, and an installation or drive bolt 44 that are applied to uninsulated conductors 86, 88 as shown in FIGS. 5 and 6, to interconnect the conductors under substantial compression. C-shaped body member 52 includes outer and inner surfaces 54, 56 respectively, a transverse section 58, extending laterally to opposed arcuate ears 60 defining wire or conductor grooves 62 that converge from a wide end to a narrow end along the transverse section 58. One of the ends 67 is a bolt receiving end, having an inwardly directed flange 66 with a bolt receiving aperture 68 extending therethrough. Inwardly directed flange 66 is preferably disposed centrally of the transverse section 58. C-shaped body member 52 further includes an axial corrugation 64 extending from a far end to the transverse section 58 at the bolt receiving end 67, defining an a open groove 65 on the wedge proximate surface of the C-shaped body member between the arcuate ears 60. The groove 65 has a concave dimension just large enough to define a bolt receiving relief. The relief permits passage of a bolt shank 46 therealong. The bolt receiving aperture 68 is positioned in the transverse section 58 so that a bolt threaded therethrough extends therefrom along the bolt receiving relief 65.

Figure 7:
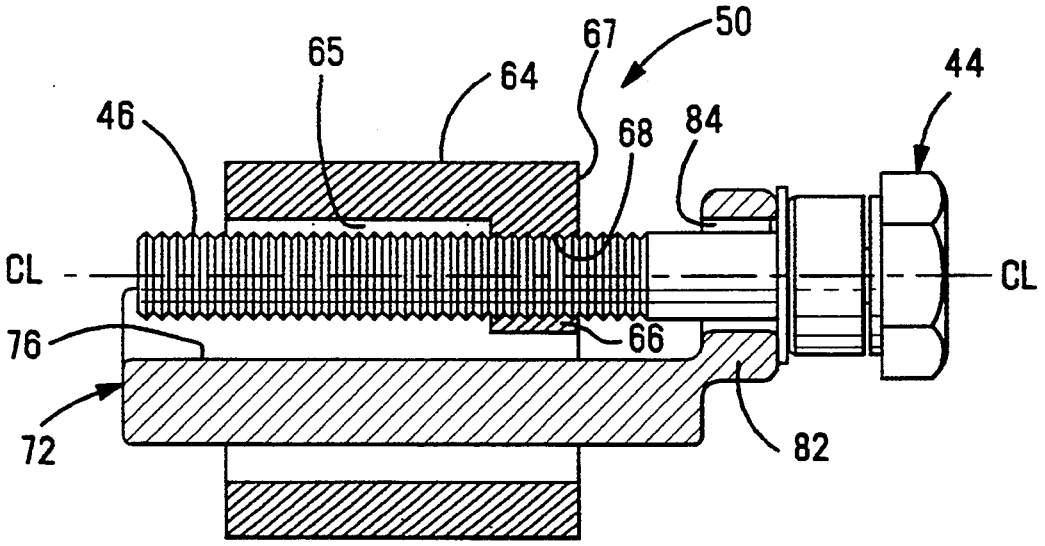
FIG. 7 is a side view taken along the line 7—7 of FIG. 5.

Wedge member 72 comprises a solid body, shaped and dimensioned to be received into C-shaped body member 52 from the relatively open end thereof, and a transverse flange 82. Wedge member 72 includes top surface 74, leading end 78 and converging concave side surfaces 80 therealong, that cooperate with opposing wire grooves 62 of C-shaped body 52 to define wire or conductor receiving channels 70 for containing conductors 86, 88 therein, as illustrated in FIGS. 5 and 6. As best seen in FIG. 6, upper surface 74 of wedge 72 includes inwardly directed groove 76 dimensioned to loosely receive inwardly directed flange 66 of C-shaped body member 52 and bolt shank 46 and concomitantly therewith allow wedge 72 to move freely to accommodate conductors 86, 88. It can be observed in FIG. 6 that the placement of the bolt groove 65 along with recess 76 in the wedge member 72 permits the shank 46 of the bolt to be positioned approximately adjacent with a plane connecting the center of the conductors 86,88 when the connector 50 is fully assembled. As seen in FIG. 7, flange 82 extends outwardly from the wedge member 72 at a wide end thereof and includes a slot 84 therethrough, through which the shank 46 of the drive bolt 44 will be inserted prior to being threaded into aperture 68 of C-shaped body member 52. Slot 84 permits the orientation of the wedge member 72 to become adjusted during application to the conductors 86, 88 thereby accommodating different sized conductors.

As seen best in FIGS. 6 and 7, the bolt shank 46 is just recessed below the plane defined by coplanar surfaces of the wedge proximate surface of C-shaped body member 52 along opposite sides of the groove 65 (shown in FIG. 6), thereby minimizing the distance between the centerline of the bolt 44 and the centerline of the wedge member 72 and minimizing skewing of the wedge member 72 as the connector 50 is assembled. This facilitates assembly of the connector 50 to the conductors ensuring that torque on the bolt is more efficiently used to drive the wedge 72 into body member 52. The spring action of the C-shaped body member is also maximized, thereby assuring high clamping force in the resultant connection.

C-shaped body member 52 and wedge member 72 may be made for example by drawn or cast copper, aluminum or other suitable materials as known in the art, with commercially available inhibitor materials such as synthetic resin, having imbedded metal particles at least coating the wire-engaging surfaces to minimize corrosion, especially if conductors of dissimilar materials are to be interconnected. The bolt 44 may also be made from bronze alloys, such as a silicon bronze alloy, aluminum such as alloy 2024 or other suitable materials as known in the art.

It is thought that the improved electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An improved electrical wire connector of the type having a C-shaped body member having laterally opposing arcuate ears extending laterally therealong and converging from a wide end to a narrow end, one of the ends being a bolt receiving end having a bolt receiving aperture extending therethrough, the C- shaped body member including a transverse section at least at the bolt receiving end, the wide end of the body member being adapted to receive a wedge member having opposed converging side surfaces concave therealong defining wire-receiving channels in cooperation with corresponding ones of the arcuate ears opposed therefrom, all for receipt thereinto of respective uninsulated wire conductors therealong to be interconnected upon compression between the wedge member and the C-shaped body member by actuation of a drive bolt causing the wedge member to be driven into the wide end of the C-shaped body member and held therein, where the drive bolt is of the type having a threaded shank threadedly engageable with the C-shaped body member and at least an outer head adapted, to be rotated by a tool whereby the bolt is adapted to be engaged by a work end of a tool having an appropriate configuration for rotation of the bolt, the improvement comprising:

said C-shaped body member includes an axial corrugation extending from a far end to said transverse section at said bolt receiving end defining an open groove on a wedge proximate surface of said C-shaped body member between said arcuate ears, said groove having a concave dimension just large enough to define a bolt receiving relief, said relief permitting passage of a bolt shank therealong, said bolt receiving end having a flange portion extending above said groove to define said bolt receiving aperture; and said bolt receiving aperture is positioned in said transverse section so that a bolt threaded therethrough extends therefrom along said bolt receiving relief, whereby the bolt shank is just recessed below a plane defined by coplanar surfaces of the wedge proximate surface along opposite sides of said open groove and adjacent said wedge member, thereby minimizing the distance between said wedge and a centerline of said bolt thus minimizing skewing of said wedge as the connector is assembled and thereby facilitating assembly.

2. The connector of claim 1 wherein said wedge member includes a bolt receiving slot shaped and dimensioned to receive said bolt shank thereinto during assembly and concomitantly therewith allow said wedge member to move freely to accommodate conductors being connected with said connector.

* * * * *